United States Patent [19]

Arai et al.

[11] 4,453,987

[45] Jun. 12, 1984

[54] METHOD FOR PRODUCING EDGED TOOLS

[75] Inventors: Tohru Arai, Toyoake; Yoshihiko Sugimoto, Nagoya, both of Japan

[73] Assignee: Kabushiki Kaisha Toyota Chuo Kenkyusho, Japan

[21] Appl. No.: 365,959

[22] Filed: Apr. 6, 1982

[30] Foreign Application Priority Data

Apr. 14, 1981 [JP] Japan ..... 56/55830

[51] Int. Cl.[3] ..... C21D 1/48

[52] U.S. Cl. ..... 148/15.5; 148/16.7; 148/144; 148/31.5; 148/6.11; 30/346.53; 428/626

[58] Field of Search ..... 30/345, 346.53; 148/15.5, 6.11, 16.7, 144, 31.5; 428/626

[56] References Cited

U.S. PATENT DOCUMENTS 3,615,908 10/1971 Waterfall ..... 148/15.5

FOREIGN PATENT DOCUMENTS 2000814 1/1979 United Kingdom ..... 148/6.11

0576350 10/1977 U.S.S.R. ..... 148/15.5

*Primary Examiner*—Sam Silverberg

*Attorney, Agent, or Firm*—Berman, Aisenberg & Platt

[57] ABSTRACT

A method for producing an edged tool which has an excellent cutting ability and durability, which comprises immersing an edged-tool material in a molten-salt bath containing a carbide-forming element, such as a Va Group element, titanium, chromium or manganese, to form a carbide layer on the surface of the edged-tool material; heating the edged-tool material to a temperature not lower than the austenite-transformation temperature of the material in a non-oxidizing gas atmosphere for a predetermined period of time; and rapidly cooling the heated material to harden it. According to the improved method of the present invention, the edged tool (having an excellent cutting ability and durability) is produced without grinding the formed carbide layer on the surface thereof.

13 Claims, 1 Drawing Figure

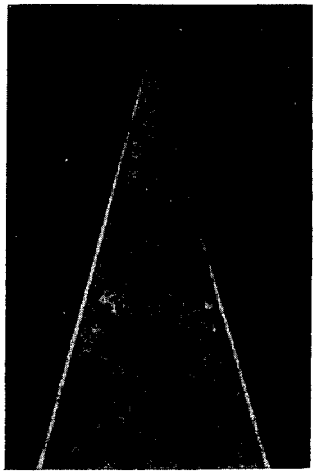

METHOD FOR PRODUCING EDGED TOOLS

BACKGROUND OF THE INVENTION

1. Field of the Invention

This invention relates to a method for producing an edged tool, such as a cutting knife.

2. Prior Art

An edged tool provided with a surface carbide coating, such as one of vanadium carbide, is excellent in its cutting ability and its durability because of the hardness of the carbide coating.

Producing the edged tool provided with the surface carbide coating, however, requires grinding to form a cutting edge portion after forming a relatively thick carbide coating on an edged tool to be treated. However, the carbide coating is extremely hard, about 3000 Vickers hardness, and grinding therefore takes considerable time. Moreover, during grinding, portions along the edge are apt to be broken off, causing considerable inconvenience. Therefore, much labor and time must be spent to produce an edged tool.

The inventors have conducted a large number of investigations in order to produce an edged tool, which is excellent in its cutting ability and durability, without having to grind a carbide layer formed on the surface thereof. An edged tool material, made of carbon steel, has been immersed in a carbide-layer-forming bath, thus forming a dense and smooth carbide layer on the surface of an edge portion thereof. The tool material is rapidly cooled to be hardened. However, this process does not produce an edged tool having a cutting-edge portion which is excellent in its cutting ability and durability.

SUMMARY OF THE INVENTION

The inventors have further investigated and have carried out a predetermined heating treatment on the surface of the edged-tool material on which a carbide layer has been formed. In other words, this heating treatment has been introduced between the aforesaid carbide-layer-forming step and the aforesaid cooling step for the quenching treatment. As a result, they have found that it is possible to produce an edged tool which is excellent in both its cutting ability and its durability and have completed a method for producing an edged tool according to the present invention.

Accordingly, one object of the present invention is to provide an improved method for producing an edged tool which has excellent cutting ability and durability, the method being capable of obviating the aforesaid conventional disadvantages and inconveniences.

Another object of the present invention is to provide a method for producing an edged tool, wherein there is no need to grind the carbide layer formed.

The foregoing and other objects are effected by the invention, as is apparent from the following description and claims.

BRIEF DESCRIPTION OF THE DRAWING

The above and other features and advantages of the present invention will become more apparent from the following description when considered in connection with the accompanying drawing wherein:

FIG. 1 is a photomicrograph (x400) showing a section of the cutting-edge portion of the edged tool produced by a method according to Example 1 of the present invention.

DETAILED DESCRIPTION OF THE PREFERRED EMBODIMENTS

An improved method for producing an edged tool according to the present invention comprises the steps of:

(a) immersing an edged-tool material, such as a cutting knife, in a molten salt bath containing (dissolved therein) a carbide-forming element, such as vanadium, niobium, titanium, chromium, manganese or the like, to form a carbide layer on the surface of the edged tool material, the edged-tool material being made of ferrous alloy containing at least 0.4 percent by weight of carbon;

(b) heating the resultant edged-tool material to a temperature (not lower than the austenite-transformation temperature of the material) in a non-oxidizing gas atmosphere for a predetermined period of time; and (c) rapidly cooling the heated material to harden it.

The starting material in the present invention, i.e. the edged-tool material to be treated, has to be composed of ferrous alloy containing at least 0.4 percent by weight of carbon. (Hereinafter, % means percent by weight.) It is preferable that the carbon content of the aforesaid ferrous alloy be as high as possible. If the carbon content is less than 0.4%, it will be difficult to form a carbide coating layer on the surface of the edged-tool material. As to the edged-tool material to be used in the present invention, an edged portion has to have been formed on the material beforehand, e.g., by grinding an edge on the material, because it is difficult to form the edged portion after treatment according to the present invention.

As a type of edged-tool material, a thin-edged material, such as a cutting knife or the like, is preferable. As to such a thin-edged material, it is relatively difficult to form the edged portion thereof by grinding. For example, it is preferable for the aforesaid material that an angle of the edge thereof (i.e., a cutting edge thereof) be at most 45° and even better when at most 30°.Thus, it is more suitable for the method according to the present invention when the edged-tool material has such a thin-edge and is of such a small size as to be difficult for manual work.

As a method for forming a carbide-coating layer on the surface of the edged-tool material, a molten salt-dipping process is preferable. The edged-tool material is dipped in a molten salt bath (containing a carbide-layer-forming element, such as vanadium or the like, dissolved therein) and is maintained therein. In addition to the aforesaid molten salt-dipping process, a chemical vapor deposition process and a physical vapor deposition process are known. However, the latter two processes are not as good; they present additional problems, such as complexity of apparatus required for these processes.

For the molten salt bath, it is preferable to use a bath prepared, e.g., by heating boric acid or borate, such as borax or the like, to its molten state to form a molten bath and by adding a carbide-forming element, such as a Va-Group element [e.g. vanadium (V), niobium (Nb) and tantalum (Ta)], titanium, chromium or manganese, in the form of powder of metal, alloy, oxide or chloride. When a carbide-forming element in oxide form is dissolved in the molten bath, a boron-supplying material (wherein the boron is not bound to oxygen) should be further incorporated in the bath as a reducing agent for the oxide.

On the other hand, salt baths other than the aforesaid molten salt bath (composed of boric acid or borate) may be used. However, these other salt baths have problems in stability of the bath and uniformity of the formed carbide layer.

With respect to the treating temperature, it is preferable that the bath temperature be as low as possible. If the treating temperature is too high, crystal growth in substrate steel occurs in the carbide layer so that steel with the formed layer is liable to be brittle. However, when the treating temperature is lower than 700° C., the forming velocity of the carbide layer is significantly decreased. Therefore, it is preferable that the treating temperature be in the range from about 800° C. to 1200° C.

The treating time depends upon the thickness of the required carbide layer. When the treating time is longer, a thicker carbide layer is obtained. The thickness of the carbide coating layer usually required for an edged tool is about 5 microns. For the present invention no grinding is required after treatment; if the formed layer is too thick, the edge of the obtained edged tool will be dull. According to the present invention, therefore, the thickness of the layer is preferably about 2 to 3 microns.

Then, the edged-tool material on which the carbide layer has been formed is heated (to a temperature not lower than the austenite-transformation temperature of the material) in a non-oxidizing gas atmosphere for a predetermined time period.

The heating time depends upon the heating temperature. When a lower heating temperature is employed, a longer heating time is necessary. For example, when the heating temperature is 900° C., the required heating time is about 10 hours. Also, when the heating temperatures are 1000° C. and 1100° C., the required heating times are about 5 hours and 1 hour, respectively. In the meantime, the austenite-transformation temperature varies within the range of from about 700° C. to 900° C. in accordance with the composition of the steel.

When carrying out this heating treatment, no molten-bath material (used in the prior step) should be permitted to adhere to the surface of the edged-tool material to be treated. If the molten-bath material adheres thereto, formation of the carbide coating layer (i.e., the aforesaid prior step) is continued at the portion of the edged-tool material where the bath material adheres. It therefore becomes impossible to carry out the heating treatment of this invention at that portion.

The heating treatment is carried out in a non-oxidizing gas atmosphere to avoid possible inconveniences, such as oxidation of the surface of the edged-tool material and the like. As a non-oxidizing gas atmosphere, nitrogen gas, argon gas, hydrogen gas, a vacuum or the like is used.

As a final step, the edged-tool material, thus heated, is rapidly cooled (to harden) by dipping the material in water or oil or by contacting it with a non-oxidizing gas. Other appropriate coolants are alternatively used for hardening. The hardening conditions depend upon the composition of the edged-tool material (the substrate) to be treated; therefore conventional hardening conditions are suitable.

By carrying out these steps according to the present invention, as described above, the intended edged tool is obtained. A thus-obtained edged tool need not be further ground to form an edge or cutting portion thereon; it is useful as it is. The edged tool is excellent in both its cutting ability and durability.

In the meantime, as usual, when the carbide-layer coating treatment is carried out on a surface of a steel material, the carbide-coating layer is formed on the surface thereof in the molten bath; then the steel material is taken out of the bath. Immediately thereafter, the steel material is rapidly cooled to be hardened.

There is no apparent reason why heat treatment is required prior to hardening to achieve the benefits inherent from this invention.

However, the following rationale is proposed, considering that the supply of carbon from the substrate is essential for forming a carbide-coating layer thereon. Near the portion of the substrate where a carbide layer is formed, carbon is consumed for forming such carbide layer and is not sufficiently supplemented from a deeper portion of the substrate under certain conditions. As a result, a portion exists (between the substrate and the carbide layer) where there is an inadequate amount of carbon for hardening. In a specific article, such as an edged tool, the existence of such a portion, if any, will greatly affect the cutting ability and durability of the cutting edge. If these considerations are correct, the heat treatment in the present invention has an effect of rendering the carbon content more uniform in the substrate of the edged tool.

Apart from the propriety of this assumption, it has been confirmed that the heat treatment (which is not usually required) is essential for producing the edged tool according to the present invention. The present invention is characterized by introducing an unusual heat treatment, i.e., the heat treatment by which the edged tool (already at hardening temperature within a molten treating bath) is further heated.

Having generally described this invention, a further understanding is obtained by reference to certain specific examples, which are provided herein for purposes of illustration only and are not intended to be limiting unless otherwise specified.

EXAMPLE 1

A molten borax bath of 1025° C. was prepared in an electric furnace filled with an air atmosphere. In this molten borax bath, 20% by weight of vanadium oxide ($V_2O_5$) powder and 5% by weight of boron carbide ($B_4C$) powder were added to 75% by weight of borax. An edged-tool material was immersed in this treating bath and maintained therein for 2 hours. [The material was a cutting knife made of high-speed tool steel (equivalent to Japanese Industrial Standard SKH 9) and having a cutting-edge angle of 13°; the width, 20 mm; the length, 195 mm; the thickness, 0.7 mm]. Thereafter, the material was taken out of the bath. The resultant material was washed with boiling water to remove the treating-bath material adhering thereto.

Then, this material was heated to a temperature of 1070° C. in an electric furnace filled with a nitrogen gas atmosphere and maintained therein for 1 hour. Thereafter, the material was taken out of the furnace and subjected to oil cooling for hardening with conventional oil at room temperature, thereby producing an edged tool according to this Example.

This edged tool was provided with a vanadium carbide (VC) coating layer over its entire surface. The layer was dense, and the thickness thereof was about 2 microns. A cross-section of the cutting portion of this edged tool is shown in FIG. 1 by a photomicrograph.

The edged tool was excellent in both its cutting ability and durability.

EXAMPLE 2

A molten borax bath of 1025° C. was prepared, wherein 20% by weight of ferro-niobium alloy (Fe-Nb) powder was added to 80% by weight of borax. An edged-tool material was immersed in this treating bath and maintained for 1 hour therein. [The edged tool material was a cutting knife made of martensitic-stainless steel (equivalent to Japanese Industrial Standard SUS 440A) and having a cutting edge angle of 32°; the width, 16 mm; the length, 170 mm; the thickness, 0.9 mm.] Thereafter, the edged-tool material was taken out of the furnace and subjected to oil cooling. In the same manner as in Example 1, the treating bath material, adhering to the surface of the treated material, was completely removed therefrom. The treated material was then heated and maintained in a vacuum furnace at $10^{-3}$ torr and 1070° C. for 1 hour. Thereafter, the resultant material was exposed to a nitrogen gas at room temperature in order to be cooled for hardening. An edged tool was thus produced.

The edged tool according to this Example was satisfactory in both its cutting ability and durability. On the surface of the edged tool a dense niobium carbide (NbC) layer (having a thickness of about 3 microns) was formed. The substrate thereof was in martensite.

EXAMPLE 3

In the same manner as described in Example 2, a molten borax bath at 1025° C. was prepared, wherein 20% by weight of vanadium chloride ($VCl_3$) powder was added to 80% by weight of borax. The same edged-tool material as employed in Example 2 was immersed in this treating bath and maintained for 2 hours therein. Thereafter, the edged-tool material was taken out of the furnace and subjected to oil cooling. In the same manner as in Example 1, the treating bath material, adhering to the surface of the treated material, was completely removed therefrom. The treated material was then heated and maintained in a vacuum furnace at $10^{-3}$ torr and 1070° C. for 1 hour. Thereafter, the resultant material was exposed to a nitrogen gas atmosphere at room temperature in order to be cooled for hardening. An edged tool was thus produced.

The edged tool according to this Example was satisfactory in both its cutting ability and durability. On the surface of the edged tool a dense vanadium carbide (VC) layer (having a thickness of about 4 microns) was formed. The substrate thereof was in martensite.

What is claimed is:

1. A method for producing an edged tool without the need to grind a carbide layer, comprising the steps of:

(a) immersing tool material with a cutting edge in a molten-salt bath comprising molten boric acid or borate and a carbide-forming element (to form a carbide layer on the surface of said tool material, said tool material being made of ferrous alloy containing at least 0.4 percent by weight of carbon);

(b) heating said tool material to a temperature not lower than the austenite-transformation temperature of said material in a non-oxidizing gas atmosphere for a predetermined period of time; and (c) rapidly cooling and thus hardening said heated material.

2. A method according to claim 1, wherein said carbide-forming element is a member selected from the group consisting of a Va Group element, titanium, chromium and manganese.

3. A method according to claim 2, wherein said carbide-forming element is in alloy form.

4. A method according to claim 2, wherein said carbide-forming element is in chloride form.

5. A method according to claim 2, wherein said carbide-forming element is in oxide form and said molten-salt bath further comprises a boron-supplying material wherein boron is not bound to oxygen.

6. A method according to claim 1, wherein said tool material has a cutting-edge angle of no more than 45°.

7. A method according to claim 6, wherein said cutting-edge angle of the tool material is not larger than 30°.

8. A method according to claim 1, wherein said non-oxidizing gas atmosphere is a member selected from the group consisting of nitrogen gas, argon gas, hydrogen gas and a vacuum.

9. A method according to claim 1, wherein the thickness of said carbide layer formed on the surface of the tool material is not in excess of about 5 microns.

10. A method according to claim 9, wherein said thickness of the formed carbide layer is from about 2 to 3 microns.

11. A ferrous-alloy tool containing at least 0.4 percent by weight of carbon and having a non-ground sharp and durable, in-situ formed, carbide-coated edge, the tool having a carbide layer, which does not exceed about 5 microns, on its sharp edge.

12. An edged tool having excellent cutting ability and durability comprising a sharp cutting edge having a cutting-edge angle of not more than 45° and being made of ferrous alloy containing at least 0.4 percent by weight of carbon, said edged tool having (a) no ground end surface adjacent to said sharp cutting edge and (b) a non ground carbide layer having a thickness of not more than 5 microns both on said sharp cutting edge and on an entire end surface of said edged tool adjacent to said sharp cutting edge.

13. An edged tool having excellent cutting ability and durability prepared by the method of claim 1.

* * * * *